US006257414B1

(12) United States Patent
Gerhardt et al.

(10) Patent No.: US 6,257,414 B1
(45) Date of Patent: Jul. 10, 2001

(54) ROLLER SIFTING AND DISPERSING MACHINE

(75) Inventors: Klaus Gerhardt, Rheurdt (DE); Werner Gawlitta, Tegelen (NL)

(73) Assignee: G. Siempelkamp GmbH & Co., Krefeld (DE)

( * ) Notice: Subject to any disclaimer, the term of this patent is extended or adjusted under 35 U.S.C. 154(b) by 0 days.

(21) Appl. No.: 09/456,390

(22) Filed: Dec. 8, 1999

(30) Foreign Application Priority Data

Dec. 14, 1998 (DE) ..... 198 57 498

(51) Int. Cl.[7] ..... B07C 5/12

(52) U.S. Cl. ..... 209/667; 209/659; 209/660; 209/671; 209/672; 209/673

(58) Field of Search ..... 209/659, 660, 209/667, 671, 672

(56) References Cited

U.S. PATENT DOCUMENTS 2,966,267 12/1960 Dunbar .

4,871,073 10/1989 Berry et al. .

FOREIGN PATENT DOCUMENTS 0328067 7/1994 (EP) .

*Primary Examiner*—Donald P. Walsh
*Assistant Examiner*—Mark J. Beauchaine
(74) *Attorney, Agent, or Firm*—McGuireWoods LLP

(57) ABSTRACT

A roller sifting or dispersing machine for the classification or dispersing of wood chips, fibers, or similar materials and to the utilization of an above-described roller sifting or dispersing machine. The roller sifting machine includes annular grooves and annular crosspieces. An outer sheathing surface of each annular crosspiece is provided with adjoining teeth in the circumference direction. The front tooth-side in the direction of rotation is steeper than the adjoining tooth back-side. The crosspiece and teeth of a roller also form a gradient that is opposed to the adjacent roller but has the same gradient height. The leading tooth sides of the circulating teeth create a pitching effect on the particles of the material to be sifted so that clogging of the roller set are avoided and an accelerated movement towards the exit end is achieved. By the continuous opposing movement of the teeth, clogging of these openings for the passage of chips is avoided. Also, the separation effectiveness can be regulated by modification of the roller revolution speed.

27 Claims, 8 Drawing Sheets

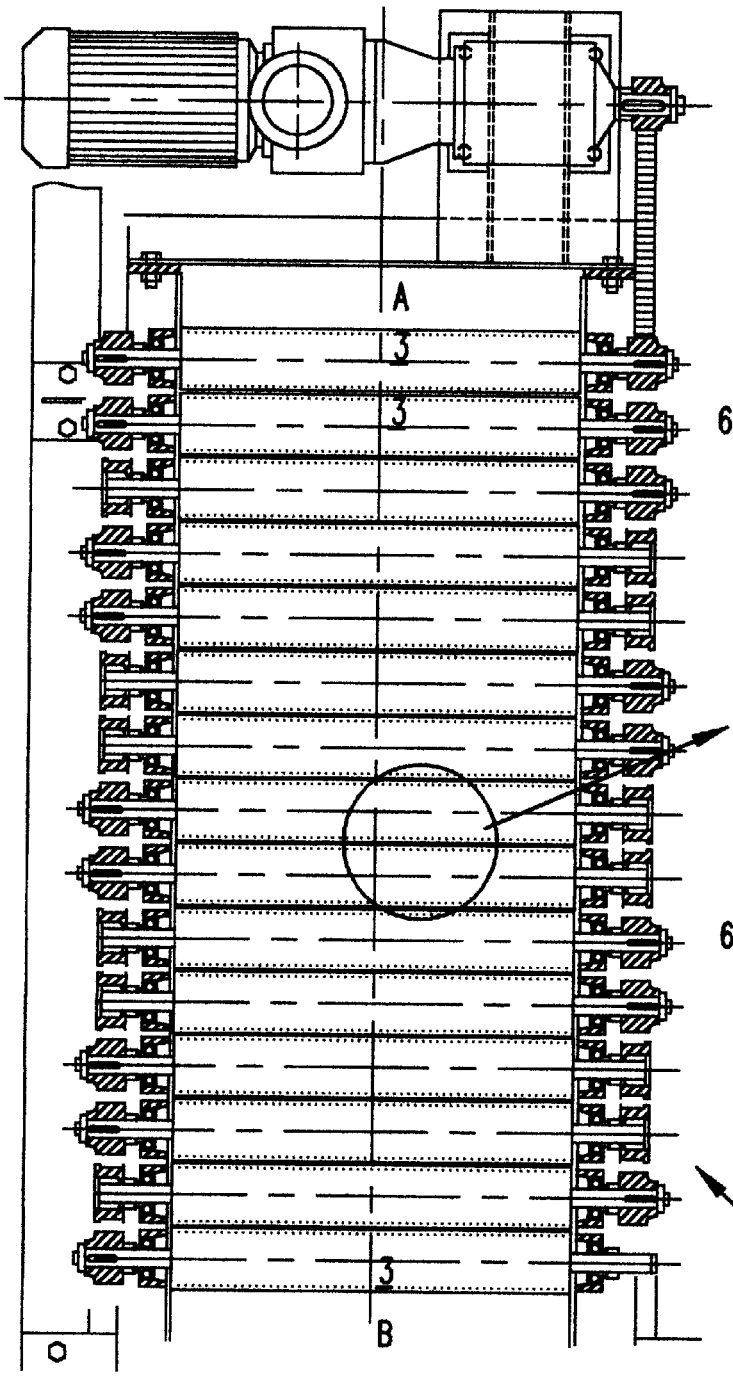
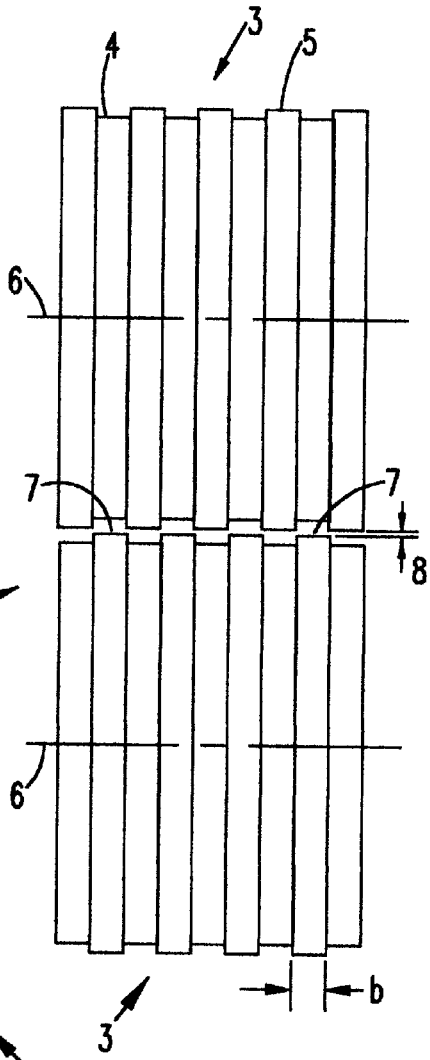
FIG. 2
FIG. 1

ROLLER SIFTING AND DISPERSING MACHINE

FIELD OF THE INVENTION

The invention generally relates to a roller sifting or dispersing machine for the classification or dispersing of wood chips, fibers, or similar materials and to the utilization of an above-described roller sifting or dispersing machine.

BACKGROUND SECTION

The problems arising in sifting and classification, as well as a pertinent portion of the state of the art, are described in EP 0 328 067. This published patent protects rollers whose sheathing surface is provided with tapering projections separated by tapering indentations. Neighboring rollers are arranged such that the outer ends of the projections are always opposite each other and are separated by an axially parallel gap; this gap defines the thickness of the chips to be sifted.

The prior art machine is described in U.S. Pat. 2,566,267. Here the annular grooves with a flush base as well as the crosspieces with a flush sheathing surface are always oblique to the roller axis.

SUMMARY OF THE INVENTION

The objective of the invention is to improve the sifting/classification effectiveness of the prior art described machine.

The objective is achieved by the fact that the annular grooves as well as the annular crosspieces that separate them, are located perpendicular to the surface of the roller axis, and the outer sheathing surface of each annular crosspiece is provided with adjoining teeth in the circumference direction; the front tooth-side in the direction of rotation is steeper than the adjoining tooth back-side, whereby, in the axial view, the crosspiece and teeth of a roller form a gradient that is opposed to the adjacent roller but has the same gradient height.

The leading tooth sides of the circulating teeth create a pitching effect on the particles of the material to be sifted/dispersed, so that clogging of the roller set are avoided and an accelerated movement, especially of the coarse matter, towards the exit end is achieved. Active impulses are generated only on the leading tooth-side while the particles falling on the tooth-backs essentially slide off. By the continuous opposing movement of the teeth, clogging of these openings for the passage of chips is avoided. In addition, the separation effectiveness can be regulated by modification of the roller revolution speed. For this, several sequentially switched roller sets with variable drives may be provided.

It is also possible to influence the separation efficiency by choosing different radial tooth-heights. Thus, the crosspiece teeth of the last rollers may exhibit maximal tooth height.

Fundamentally, it is possible to shape the bottom of each annular groove as a flat surface. For certain applications, however, is has proven advantageous for the bottoms of each annular groove to be provided with contiguous teeth in the circumference direction whose contours correspond to the crosspiece teeth, whereby the teeth of the annular groove are offset by a fraction of a tooth-width and tooth-backs slightly overlap the crosspiece teeth in the radial direction.

To avoid jamming of particles of the sifting material in the grooves, it is useful that the teeth of the groove are offset by less than one half of the tooth width in the rotation direction.

The previously described pitching effect is especially effective when the leading tooth-side makes an angle of about 45 degrees with the radius of the tooth-base.

It is further advantageous if a top-view rectilinear gap is provided between two adjacent rollers, such gap having a size of about 0.2× the height of the tooth. This relationship results from the determination that the gap size depends on the load on the teeth, where the loading with large teeth is higher than with fine teeth.

An especially favorable production process of the rollers can be achieved when each roller consists of individual pre-fabricated rings drawn on a roller body, where the roller body may consist of solid rods or thick walled pipe. The rings may have the same width, e.g. 3 mm, whereby the rings forming the annular grooves have an outside diameter only about 2 mm smaller than the outer diameter of the rings forming the annular crosspiece. For the construction of larger openings for the passage of chips, two or more identical rings may be arranged next to each other.

In view of the above, the invention concerns a roller sifting or dispersing machine for the classification or dispersing of wood chips, fibers, or similar materials, having at least one roller set that consists of several rollers arranged axially in parallel next to each other and having the same rotation direction; these rollers form a roller bed that extends in a longitudinal direction transverse to the rollers and has a feeding end for the material to be sifted/dispersed, as well as an exit end for the coarse material. Each roller turns toward the exit end with its upper side defining the roller bed; the roller is equipped with numerous annular grooves evenly spaced in the axial direction and separated by annular crosspieces; these grooves and crosspieces form the outer sheathing of the roller and adjacent rollers are arranged such that the crosspieces of one roller are opposite the grooves of its neighbor, thus being largely closed along their circumference when viewed along the roller bed surface, but having openings for the passage of chips in the direction perpendicular to the roller bed surface.

Other features of the invention as well as their utilization possibilities are the subject of the dependent claims and will be further clarified by embodiment examples that will point out further advantages of the invention.

BRIEF DESCRIPTION OF THE DRAWINGS

The drawings serve as examples of embodiment forms of the invention. The drawings show:

FIG. 1 shows a top view of a sifting or dispersing machine;

FIG. 2 shows a detail marked in FIG. 1 on a larger scale and schematic depiction.

DETAILED DESCRIPTION OF THE INVENTION

Figure 3:
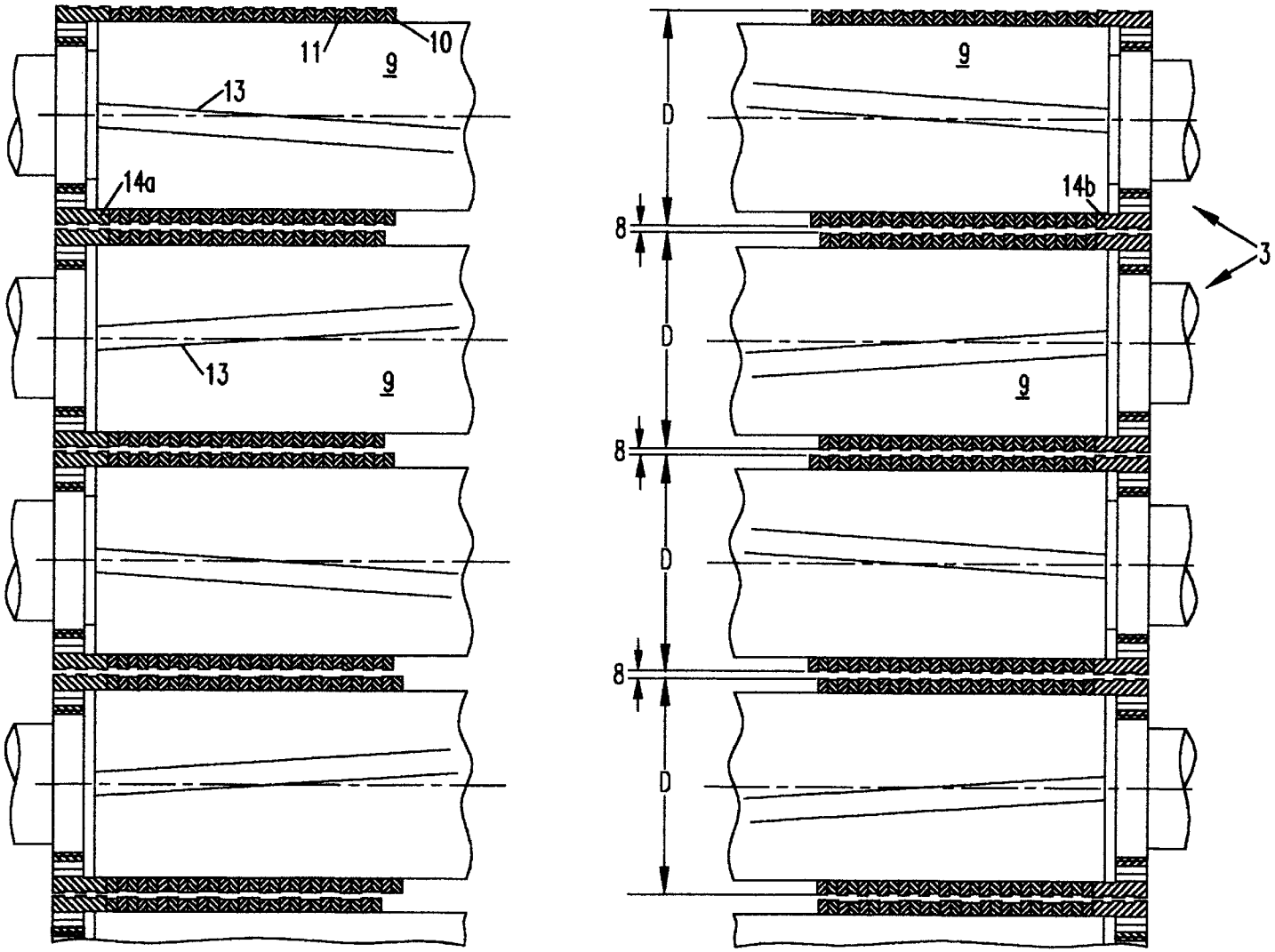
FIG. 3 shows a detail of a horizontal cross-section of a roller set of a sifting and dispersing machine, in which each roller consists of individual pre-fabricated rings drawn on a roller body.

FIG. 1 shows a roller sifting or dispersing machine for the classification or distribution of wood chips, fibers, or other similar materials. Illustrated is a roller set 1 constituted of several rollers 3 in an axially parallel arrangement and having a common rotation direction 2; these rollers make up a roller bed that extends longitudinally at right angle to the rollers and is provided with an input end A for the materials to be sifted or dispersed and an output end for the coarse materials. The upper side of each roller 3, which defines the roller bed surface, turns toward the output end B and is provided with numerous axially equi-spaced annular grooves 4 (see FIG. 2) that are separated by annular crosspieces 5 which constitute the outer sheathing surface of the roller 3. The annular grooves and the annular crosspieces are perpendicular to the surface of the roller axis 6 whereby adjoining rollers 3 are arranged so that the annular crosspieces 5 of one roller 3 are opposite the annular grooves 4 of the other roller, thus forming a largely closed surface, if viewed from the top of the roller bed surface, yet forming openings for the passage of chips 7, as can be seen from FIG. 2. Thereby the width b of the annular cross members 5 are at most as large as that of annular grooves 4. In particular, FIG. 2 shows that in a top view a rectilinear slot 8 is formed between adjoining rollers 3.

Figure 4:
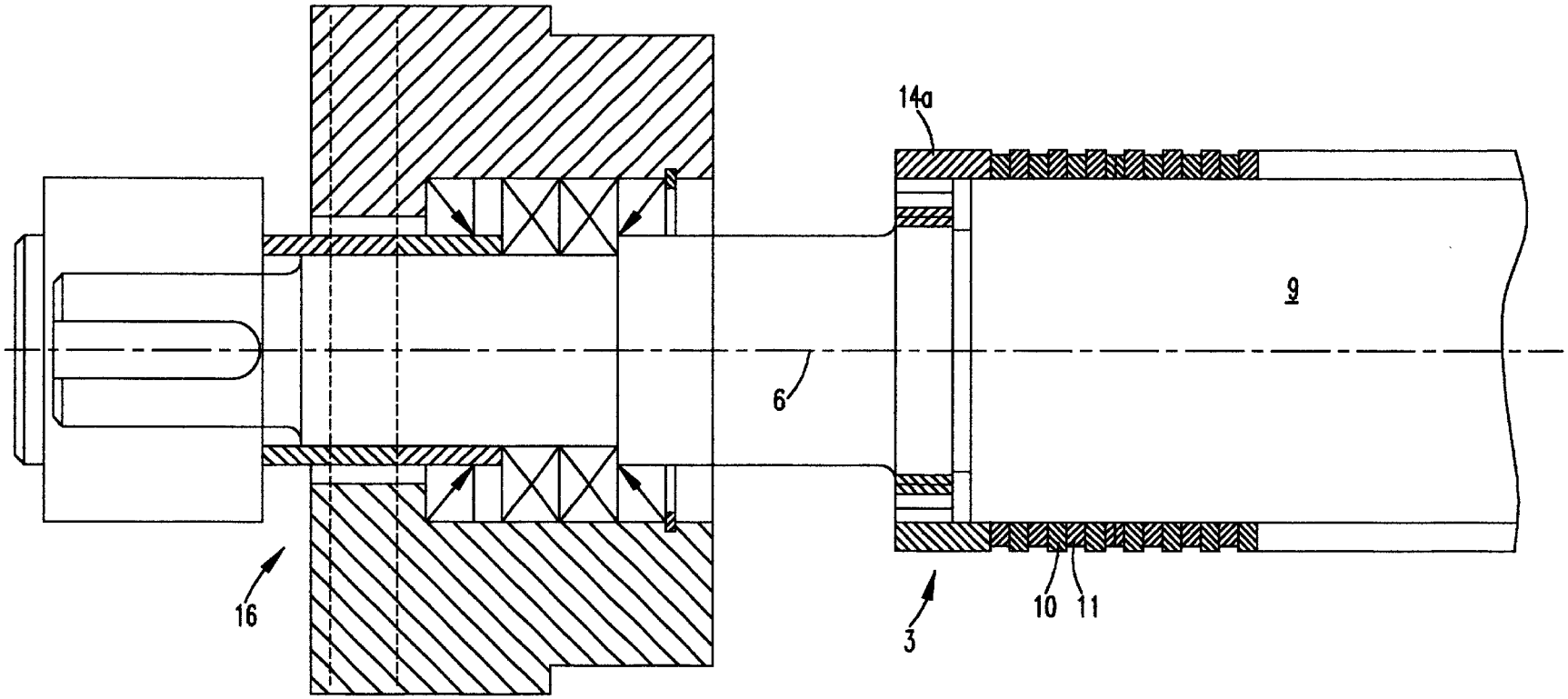
FIG. 4 shows a horizontal cross-section of a left orientation of a roller according to FIG. 3
Figure 5:
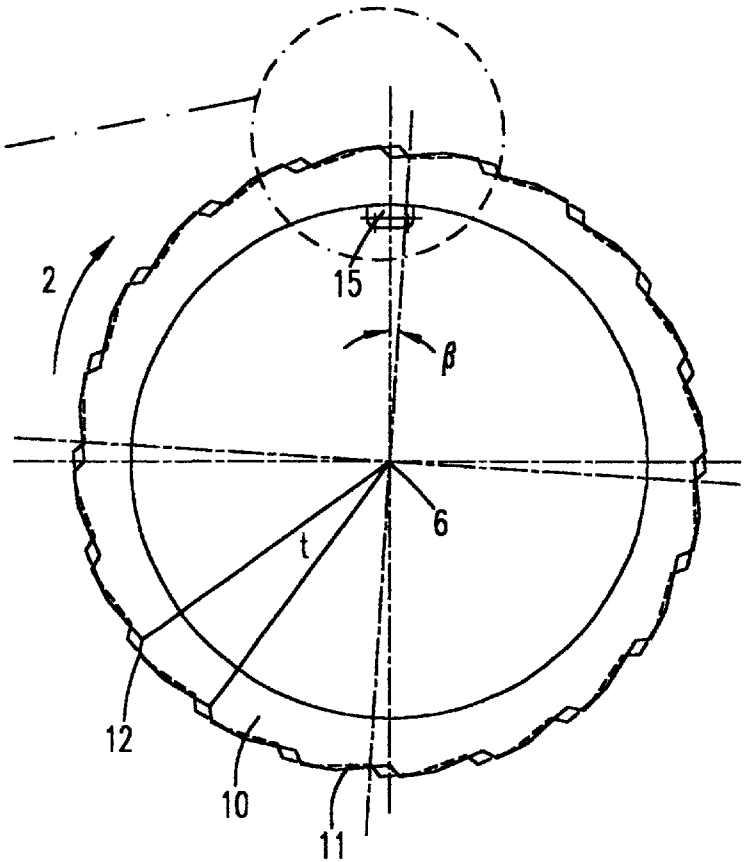
FIG. 5 shows a front view in solid lines of a larger diameter ring to which a ring of a smaller diameter is adjoined and shown by dotted lines.

According to the embodiment forms depicted in FIGS. 3 to 5, the roller 3 consists of individual pre-fabricated rings 10, 11 drawn on the roller body 9. Here the roller body 9 can be made of solid rods or of thick-walled pipe material. FIGS. 3 and 4 especially show that rings 10 of a greater diameter form the annular crosspieces 5, while rings 11 of a lesser diameter form annular grooves 4 when placed between rings 10.

Figure 6:
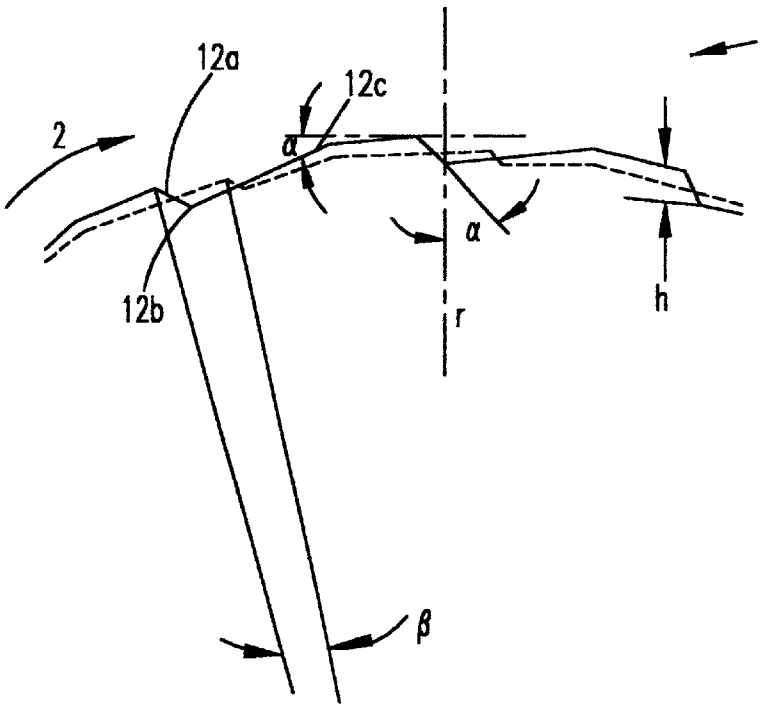
FIG. 6 shows a he detail noted in FIG. 5 on a larger scale.

The outer sheathing surface of each annular crosspiece 5 as well as the floor of each annular groove 4, is equipped with teeth 12 placed next to each other circumferentially; the tooth leading side 12*a* in the direction of rotation 2 is shaped more steeply than the tooth back edge 12*c* leading to the base 12*b* of the following tooth side 12*a*. Here the tooth leading side 12*a* makes an angle of about 45 degrees with the radius r of the tooth base 12*b*. This angle is shown as alpha in FIG. 6. FIG. 6 also indicates that each tooth-back 12*c* of the annular member teeth 12 makes an angle of 3 to 6 degrees (angle gamma) with the tangent of their revolution circle.

The teeth 12 of the annular grooves 4 are shaped similarly to those of the annular cross members 5, but are radially offset by a fraction of a tooth part t, preferably less than one half of tooth part t. FIG. 5 indicates that the annular crosspiece teeth 12 slightly overlap the axially adjacent tooth backs 12*c*. As viewed in the axial direction, the annular crosspiece teeth 12 form a gradient 13, which is shown schematically in FIG. 3. To achieve an optimally even distribution of the chips over the width of the roller bed, it is appropriate that this gradient 13 be in the opposite direction to that of the gradient of the adjoining roller, but have the same gradient height.

According to FIGS. 3 and 4, rings 10 and 11 are braced in the axial direction by front view right and left handed nuts 14*a* and 14*b*. For a definitive connection of rings 10 and 11 to the roller body 9, the rings may be equipped with a cam 15 to fit in a groove extending the whole length of the roller body 9. In a useful alternate method, not shown in detail in the drawing, an inclined protuberance may be provided on the roller body 9 on which rings 10 and 11, provided with the proper internal slot can be inserted.

The separation operation of the roller sifting or dispersing machine according to the invention can be modified by changing the roller rotation velocity. In addition, two or more identical rings 10/11 can be placed next to each other in the axial direction to create larger openings 7 for the passage of chips. Thereby the width b of a ring 10 or 11 may, for example, be 3 mm. With an outside diameter D of about 60–70 mm (deck-layer machine) each ring 10/11 is provided with 16–20 teeth 12, and with an outside diameter of about 70–80 mm (middle layer machine) each ring 10/11 is provided with about 14–24 teeth. Wide dispersing machines have outside diameters of up to 100 mm. The radial tooth height h depends on the application and amounts to about 1–3 mm in deck-layer machines and about 2–8 mm in middle layer machines. The annular groove teeth are offset to the crosspiece teeth by an angle (beta) of about 4 degrees in the rotation direction 2.

According to FIG. 4, each roller 3 is housed at both ends in bearing 16. The roller surface is abrasion resistant, preferably chrome plated.

Figure 7:
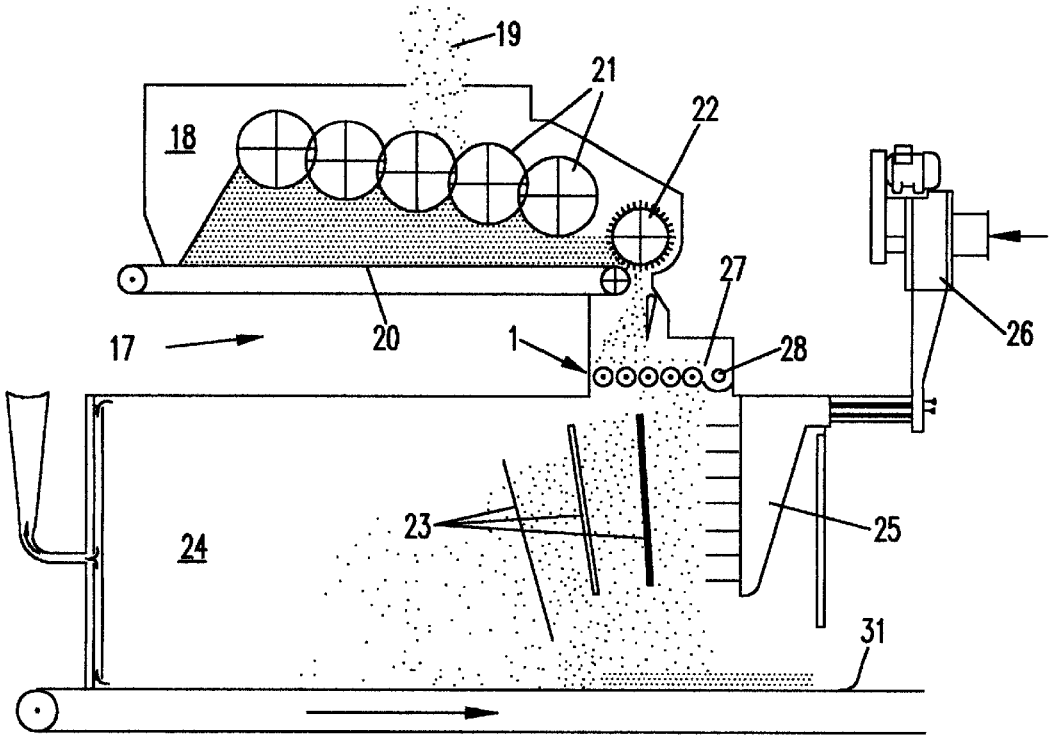
FIG. 7 shows a schematic representation of a perpendicular section of a deck-layer dispersing machine with a roller sieve arranged over a wind chamber.

FIG. 7 shows a deck-layer dispersing machine 17 with a chip bunker 18 for the reception of the sifted/dispersed material 19, with a bunker tape 20 that transports the sifted material 19 in the direction of the arrow, to a discharge location having equalization rollers 21 in chip bunker 19 and a spine roller 22. A wind chamber 24 equipped with sieves 23 is provided underneath the discharge location; the chamber is equipped with an air register 25 and an air blower 26.

Located below the described belt discharge of the bunker belt 20, is a roller set 1 according to the invention that functions as a roller sifter, i.e. having chip-passing openings 7 of equal size and serving for the separation of coarse material 27, which has traveled roller set 1 from input end A to output end B; the coarse material is discarded onto the screw conveyor 28.

Figure 8:
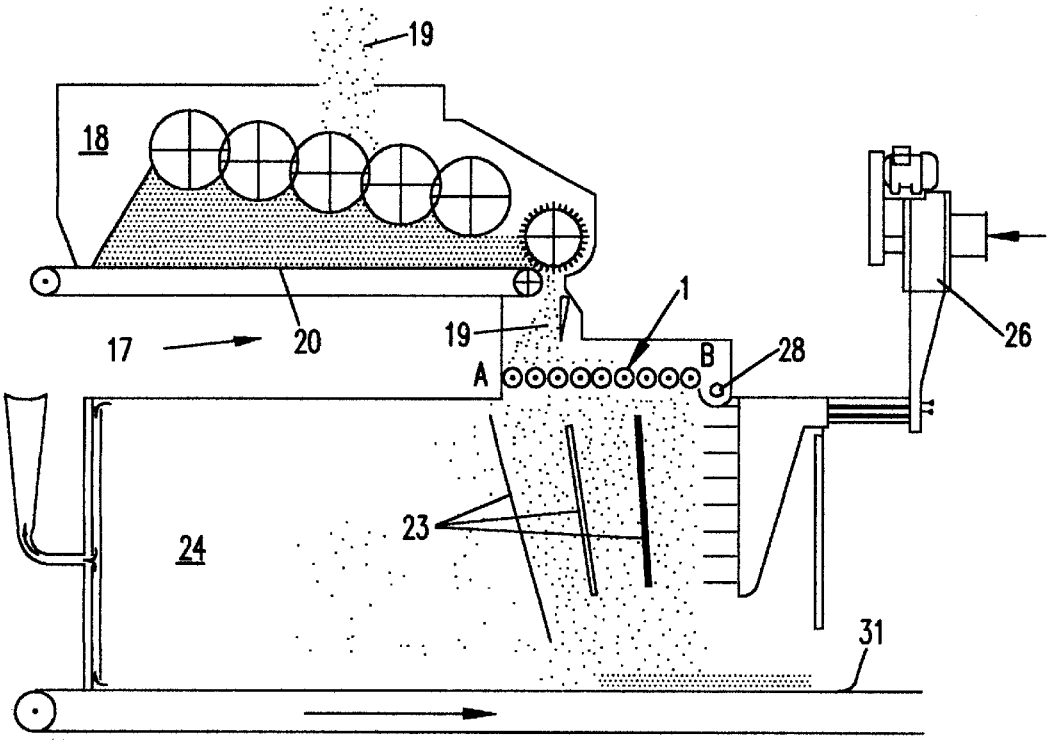
FIG. 8 is a representation according to FIG. 7, the deck-layer dispersing machine with the dosing roller arranged over the wind chamber.

FIG. 8 primarily differs from the deck-layer dispersing machine 17 of FIG. 7, in that here the roller set 1 functions as a dosing installation i.e. serves as a classifier of the dispersed material. The size of the chip-passing openings of FIG. 2 increases from A to B.

Any coarse material is also discarded in the screw conveyor 28.

Figure 9:
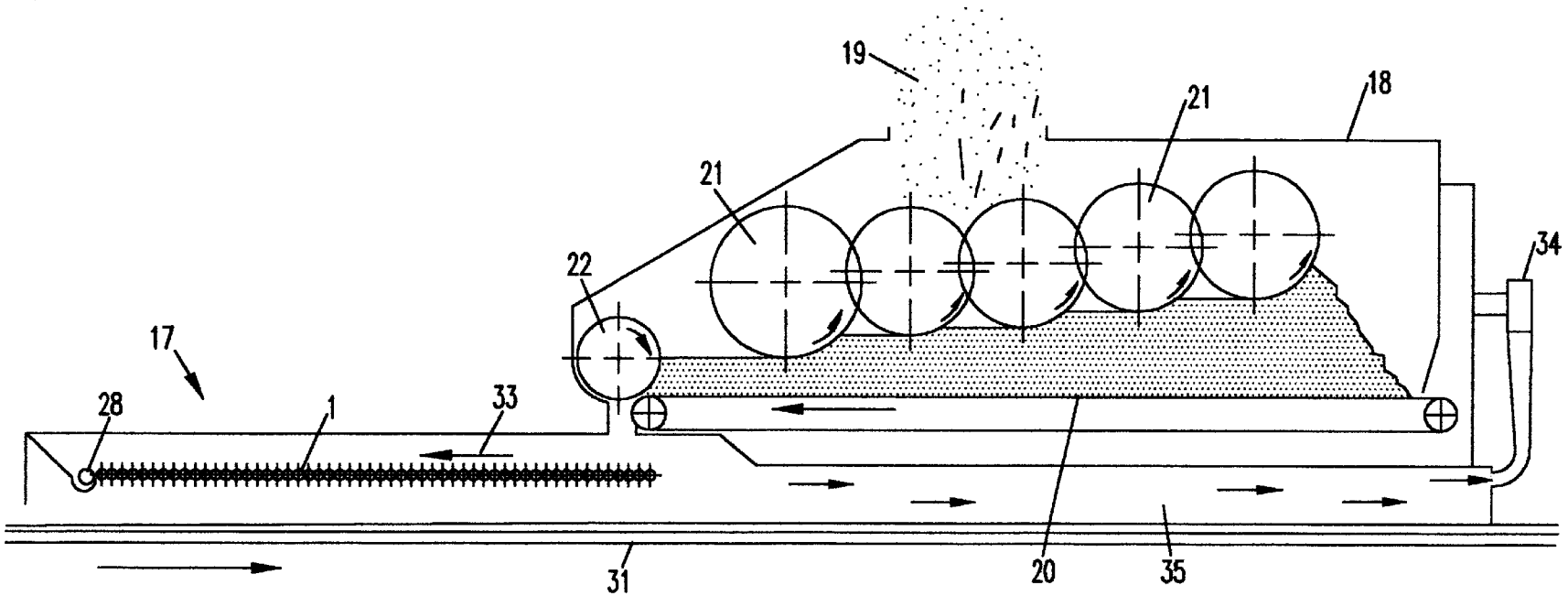
FIG. 9 shows a deck-layer dispersing machine with an installation for the supplemental loosening of the chip stream.

FIG. 9 depicts a deck-layer dispersing machine in which the chip stream is loosened mechanically and pneumatically. The chip bunker 18 corresponds essentially to that shown in FIG. 7 with its built-ins 20, 21, 22. The sift/dispersed material 19 is conveyed from the bunker belt 20 through the equalizing rollers 21 and further conveyed as an equalized height layer and at the end of bunker belt 20 is transferred onto a roller set 1 with assistance of pin roller 22, which may also be a rotating brush. In a clear gap below the roller set 1 is the usual form belt 31 that travels in the direction of the shown arrows i.e. against the conveying direction 33 of roller set 1. A coarse material screw conveyor 28 is located at the end of roller set 1. To achieve a supplemental pneumatic loosening of the chip stream, the space between the roller set 1 and the form conveyor 31 is equipped with an air suction device 34 that moves air against the conveying direction 35 of roller set 1.

Thus, a free suction channel 35 is formed between the start A of roller set 1 and the air suction device 34 shown at the right of FIG. 9 above the form conveyor 31. The air suction device 34 produces air velocities from 0.9 to 1.7 meters/sec. Under roller set 1 and above form conveyor 31. Thereby we obtain pneumatic loosening of the chip stream in addition to the mechanical loosening by roller set 1.

Figure 10:
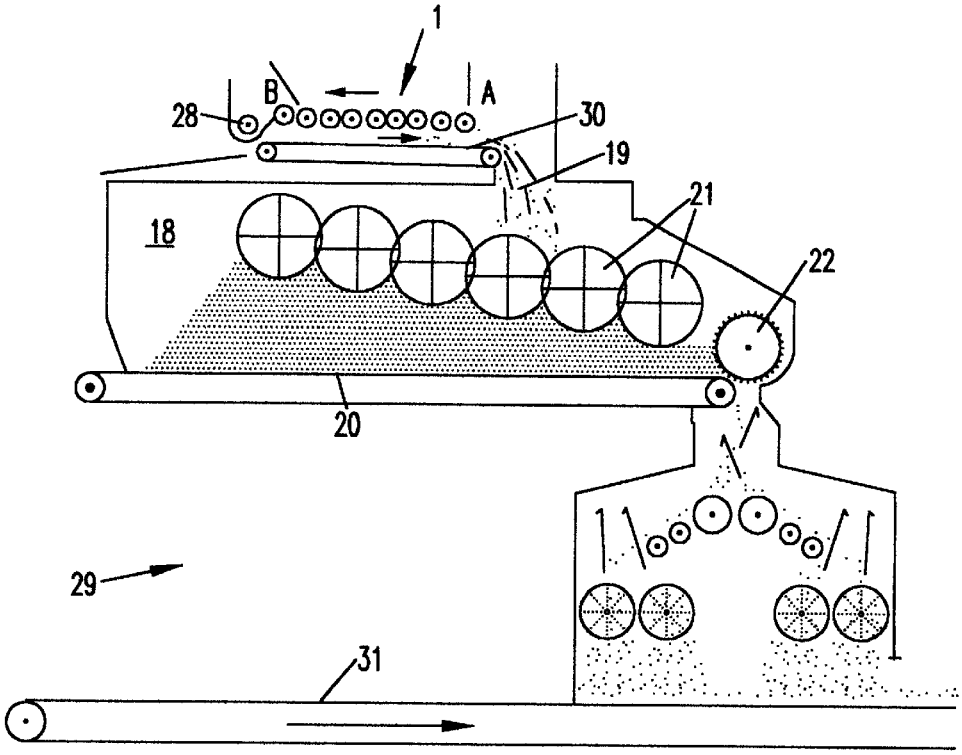
FIG. 10 is a representation according to FIG. 7, a middle layer dispersing machine with a roller sieve arranged over a bunker.

FIG. 10 depicts a middle-layer dispersing machine 29. Here the sift/dispersed material 19 to be introduced in the chip bunker is first passed on a roller set 1 that acts as a roller sieve and already removes the coarse material and conveys it to the screw conveyor 28. The sifted material is captured by a transport belt 30 and conveyed to the chip bunker 18. The sift/dispersed material 19 coming from the bunker belt 20 is separated into two partial streams by means of a device that is of no detailed interest here and then reaches form belt 31, as is shown in FIG. 7 through 9.

Figure 11:
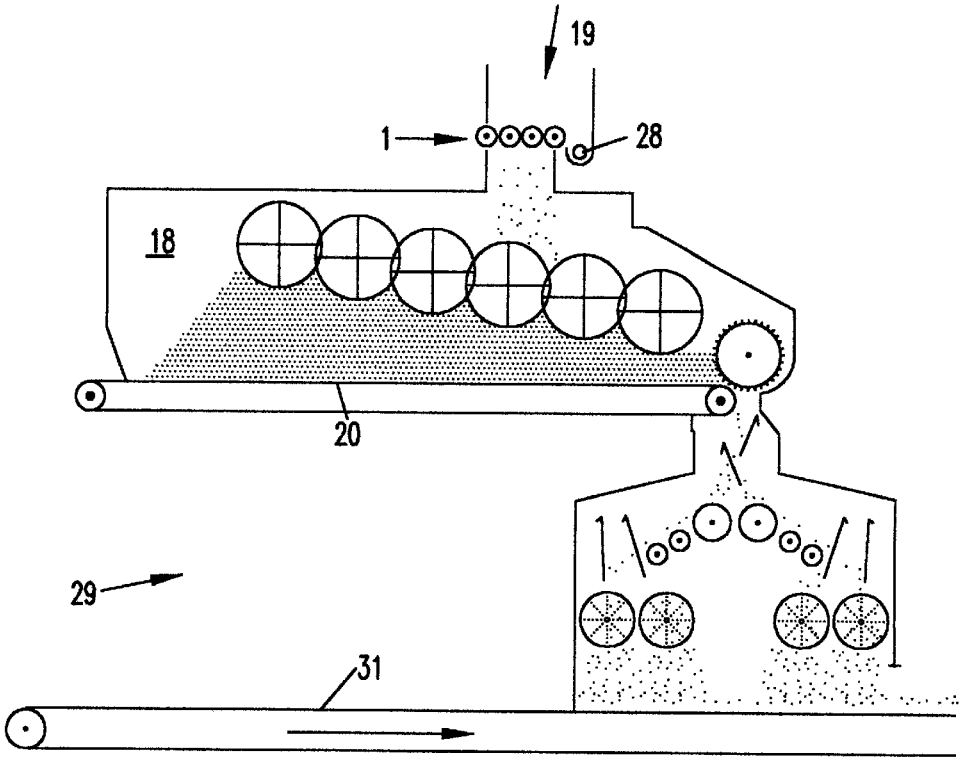
FIG. 11 shows a embodiment form according to FIG. 10 with a modified roller sieve arrangement and FIG. 12 shows a deck-layer-roller dispersing head according to FIG. 9 and, on the upper part of the figure, a size distribution diagram achievable by the use of this roller dispersing machine.

The embodiment form according to FIG. 11 differs from that of FIG. 10 essentially by the fact that the sift/dispersed material 19 passing through the roller set 1 acting as a roller sieve immediately falls in the chip bunker 18.

Figure 12:
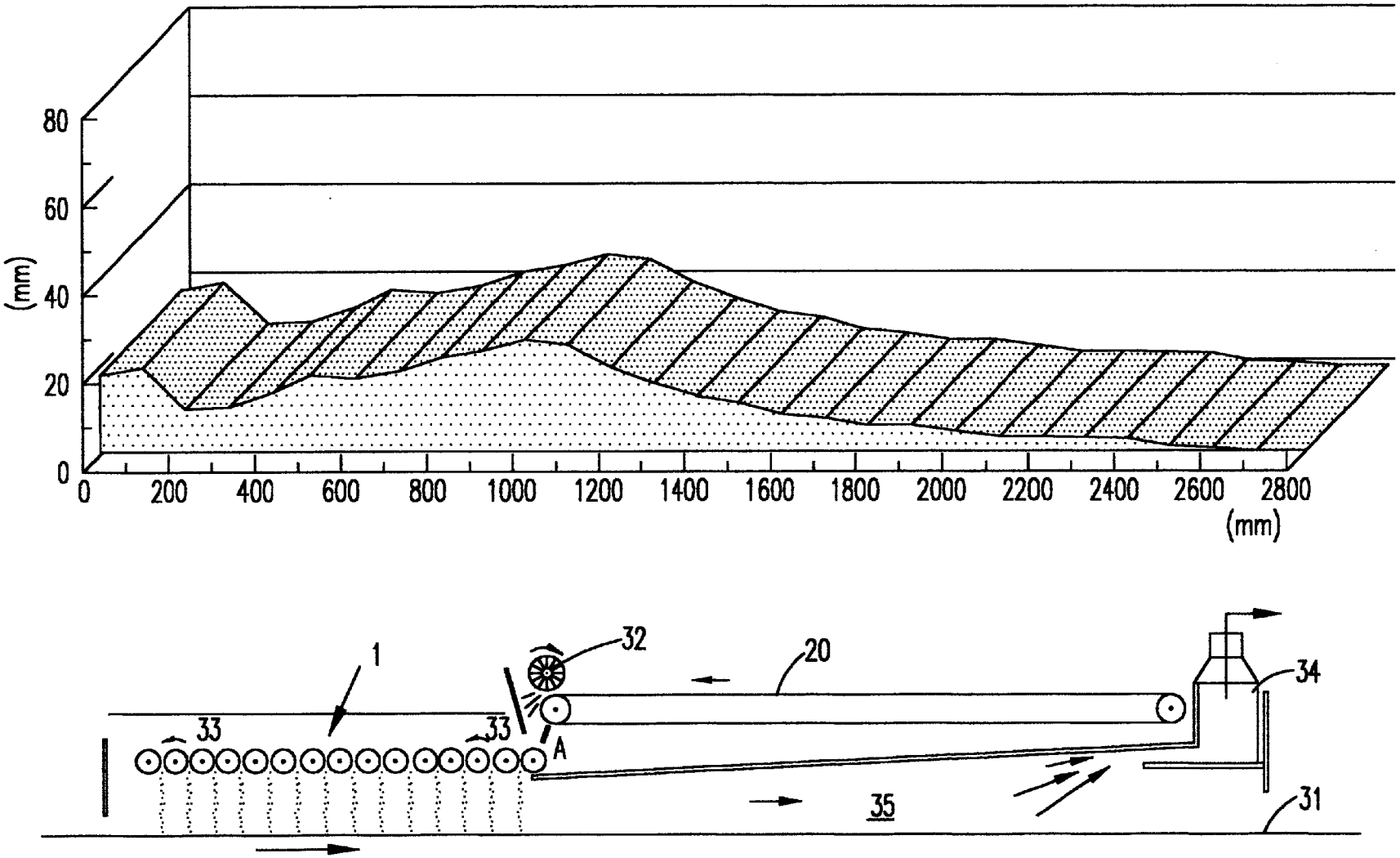

FIG. 12 shows, on its lower portion, a schematic representation of an installation according to FIG. 9 where the chip stream should be loosened both mechanically and pneumatically. The sift/dispersed material (not shown in detail) is conveyed in the usual manner by a bunker belt 20 and at the end of the belt is transferred to a roller set 1 with the aid of a rotating brush 32. In a clear space under the roller set 1 is the usual form belt 31 that travels in the direction of the shown arrow i.e. in the direction opposite to the conveying direction 33 of roller set 1; to achieve the distribution pattern shown in the upper portion of FIG. 12 a free suction channel 35 is created between the start A of roller set 1 and the external air suction device 34 above the form belt 31, whose length is at least that of the roller set 1. In addition to the mechanical loosening effected by roller set 1 we obtain a supplementary pneumatic loosening that results in the distribution diagram shown in the upper part of FIG. 12. This diagram has resulted from a revolution velocity of 325 RPM of the dispersed rollers 3 and an air suction velocity of 1.1 meters/sec. The dispersing occurred over a time period of 30 seconds with form belt 31 stationary.

The distribution diagram indicates that while the maximum dispersed -height still occurs under the first dispersed rollers of the roller set 1, this maximum is significantly lower than that achieved without an air suction device that leads to significant stretching of the distribution diagram over the form belt, whereby the stretching generated by air suction extends well into the bunker belt 20.

The invention concerns a roller sifting or dispersing machine for the classification or dispersing of wood chips, fibers, or similar materials, having at least one roller set composed of several rollers axially aligned in parallel and having the same rotation direction; together, these rollers form a roller bed that extends longitudinally at right angles to the rollers and is equipped with an input end for the material to be sieved and an output end for the coarse material, whereby each roller's upper side turns toward the output end; the rollers are equipped with numerous annular grooves axially equi-spaced and separated by annular crosspieces that form the outer sheathing surface of the roller. Adjacent rollers are arranged so that the annular cross members of one roller are opposite the annular grooves of the other roller, thus being largely closed along their circumference when viewed along the roller bed surface, but having openings for the passage of chips in the direction perpendicular to the roller bed surface. For improved sifting or classification the invention proposes that the annular grooves as well as the annular crosspieces be located perpendicular to the roller surface and that the outer sheathing surface of each annular crosspiece be equipped with circumferentially aligned teeth whose leading sides are shaped more steeply than their back edges leading to the base of the following tooth side, whereby an axial view of the annular crosspiece teeth is seen as a gradient that is in the opposite direction to that of the adjacent roller but is of the same height.

What is claimed is:

1. A roller sifting or dispersing machine for the classification or dispersing of wood chips, fibers, or similar materials, the roller sifting or dispersing machine comprising:

at least one roller set composed of several rollers aligned axially parallel and having a same rotation direction;

a roller bed formed by the rollers, the roller bed extending longitudinally at a right angle to the rollers and being provided with an input end for introduction of the material to be processed and an output end for coarse material, each of the rollers having an upper side which turns toward the output end;

each of the rollers comprising a plurality of annular grooves, the annular grooves being axially equi-spaced and separated by annular crosspieces forming an outer generating surface of each of the rollers, the annular crosspieces of one roller being arranged opposite the annular grooves of an adjoining roller thus forming in a top view onto the roller bed openings for the passage of chips, which openings having a substantially closed circumference, wherein the annular grooves and the annular crosspieces are located in planes perpendicularly to a roller axis, and the outer generating surface of each annular crosspiece includes circumferentially aligned teeth having a rotation direction leading tooth flanked shape steeper than a tooth back flank inclined to a base of a following tooth side, whereby axially the annular crosspiece teeth of a roller form a gradient that is opposite to that of the adjoining roller but includes a same gradient height.

2. The roller sifting or dispersing machine according to claim 1, wherein the tooth leading flank of the annular crosspiece teeth forms an angle of about 45 degrees with the radius of the tooth base.

3. The roller sifting or dispersing machine according to claim 1, wherein each tooth back of the annular crosspiece teeth forms an angle of 3 to 6 degrees with the tangent of their revolution circle.

4. The roller sifting or dispersing machine according to claim 1 wherein located on the bottom of each annular groove are circumferentially aligned teeth whose contours correspond to those of the annular crosspiece teeth, whereby the teeth of the groove are circumferentially offset against the annular crosspiece teeth by a fraction of a tooth pitch and radially slightly overlap the tooth backs of the axially adjoining annular crosspiece teeth.

5. The roller sifting or dispersing machine according to claim 4, wherein in the rotation direction, the teeth of the annular grooves are offset against the teeth of the annular crosspiece by less than half of a tooth pitch.

6. The roller sifting or dispersing machine according to claim 1, wherein the width of the annular crosspieces is at most as wide as the width of the annular grooves.

7. The roller sifting or dispersing machine according to claim 1, wherein the width of the annular crosspieces is about 3–9 mm.

8. The roller sifting or dispersing machine according to claim 1, wherein a rectilinear slot (top view) is created between two adjoining rollers, having a size of about 0.2× tooth height.

9. The roller sifting or dispersing machine according to claim 1, wherein the radial tooth-height is about 1–8 mm.

10. The roller sifting or dispersing machine according to claim 1, wherein the annular crosspieces have an outer diameter of about 60–80 mm and have sixteen to twenty four teeth.

11. The roller sifting or dispersing machine according to claim 1, wherein the annular crosspieces and grooves are applied to a single roller body consisting of a solid rod or of heavy-wall pipe.

12. The roller sifting or dispersing machine according to claim 1, wherein each roller is composed of axially clamped rings jointly applied.

13. The roller sifting or dispersing machine according to claim 1, wherein each roller consists of single pre-fabricated rings fitted on the roller body.

14. The roller sifting or dispersing machine according to claim 13, wherein the rings are braced in the axial direction by (front view) right and left-handed nuts.

15. The roller sifting or dispersing machine according to claim 13, wherein to obtain a positive locking connection between the rings and the roller body, an inclined protuberance is provided on the generated surface of the roller body, on which protuberance the rings, provided in their inner ring contour with an appropriate slot, are inserted.

16. The roller sifting or dispersing machine according to claim 13, wherein for the formation of larger chip passage openings two or more identical rings are axially arranged next to each other.

17. The roller sifting or dispersing machine according claim 1, wherein each roller is housed at both ends in bearings.

18. The roller sifting or dispersing machine according to claim 1, wherein the roller surface is abrasion resistant, preferably chrome-plated.

19. The roller sifting or dispersing machine according to claim 1, wherein the separation effect can be regulated by modification of the roller revolution velocity.

20. The roller sifting or dispersing machine according to claim 1, wherein there at least two roller sets, whereby, in the conveying direction, the rollers of the second set have wider annular grooves and annular crosspieces than those of the first roller set.

21. The roller sifting or dispersing machine according to claim 20, wherein the second roller set is located at a lower level than the first roller set.

22. The roller sifting or dispersing machine according to claim 1, further comprising a form belt continuously running opposite to the convening direction of the roller set and located beneath the roller set, wherein to achieve a supplemental pneumatic loosening of the chip stream, an air suction device is attached to provide a countercurrent air stream in the space between roller set and form belt.

23. The roller sifting or dispersion machine according to claim 22, wherein between the input end of the roller set and the air suction device and above the form belt, a free suction channel is created, whose length is at least as long as the roller set.

24. The roller sifting or dispersing machine according to claim 22, wherein the air suction device produces air velocities of 0.9–1.7 meters/sec. below the roller set and above the form belt.

25. The roller sifting or dispersing machine according to claim 1, is used as a roller sieve in a deck-layer dispersion machine above a wind chamber.

26. The roller sifting or dispersing machine according to claim 1, is used as a dosing roller in a deck-layer dispersion machine above a wind chamber and/or a suction channel.

27. The roller sifting or dispersing machine according to claim 1, is used as a roller sieve above a chip bunker of a middle layer dispersing machine.

* * * * *